United States Patent [19]

Yankey

[11] Patent Number: 4,722,318

[45] Date of Patent: Feb. 2, 1988

[54] CROSSBOW BOLT STABILIZER

[76] Inventor: Robert L. Yankey, P.O. Box 62, New Vienna, Ohio 45159

[21] Appl. No.: 923,950

[22] Filed: Oct. 29, 1986

[51] Int. Cl.[4] ..... F41B 5/00

[52] U.S. Cl. ..... 124/25; 124/26; 124/41 A

[58] Field of Search ..... 124/25, 24 R, 27, 26, 124/41 R, 41 A, 86, 88

[56] References Cited

U.S. PATENT DOCUMENTS

| | | | |
|---|---|---|---|
| 2,483,928 | 10/1949 | Ott | 124/41 A |
| 2,777,435 | 1/1957 | Brooks | 124/41 A |
| 3,158,145 | 11/1964 | Handy | 124/41 A |
| 3,788,299 | 1/1974 | Mathews | 124/41 R |
| 4,030,473 | 6/1977 | Puryear | 124/25 |

*Primary Examiner*—Andrew V. Kundrat
*Assistant Examiner*—Peter M. Cuomo
*Attorney, Agent, or Firm*—Biebel, French & Nauman

[57] ABSTRACT

In a crossbow of the type wherein a bolt is supported solely at its front and rear ends, a spring-loaded bolt stabilizer is provided which cooperates with the front bolt rest to maintain a bolt in position. The stabilizer may be pivotally mounted on the crossbow and biased toward a bolt-engaging position by a coil spring, and a finger tab may be provided to permit the stabilizer to be pivoted upwardly to facilitate placing a bolt on the bolt rest.

7 Claims, 5 Drawing Figures

CROSSBOW BOLT STABILIZER

BACKGROUND OF THE INVENTION

When positioned in a crossbow for firing a crossbow bolt may be received in a groove extending the length of the crossbow stock, as shown in U.S. Pat. Nos. 1,133,189 and 2,786,461, or supported adjacent its ends as shown in U.S. Pat. No. 4,206,740. In all three, above-noted patents means is provided for holding the bolt in position when the bow is in the cocked configuration.

For example, in U.S. Pat. No. 1,133,189 a combination spring and back sight is mounted at the rear of the stock to engage the rear end of a bolt positioned in a longitudinally extending groove formed in the stock and to also serve as a rear sight.

In U.S. Pat. No. 2,786,461 a magnet is received in a cylindrical seat formed near the forward end of the crossbow stock to attract magnetically the pointed steel end of the bolt received in the crossbow groove.

In U.S. Pat. No. 4,206,740 a holder made of a resilient deformable material such as thin polyethylene is mounted on the forward end of the stock and provided with a central opening split at its top for receiving the forward end of a bolt positioned on the crossbow for firing.

Additionally, with respect to bows of the non-crossbow type, various devices for holding an arrow in the bow are shown in U.S. Pat. Nos. 2,483,928; 2,743,716; 3,059,631; 3,406,676; 3,499,414; 4,038,960; and 4,577,612.

It will be apparent that the activity in this area evidenced by the above-noted patents indicates a continuing concern on the part of crossbowman with maintaining a crossbow bolt in position in the cocked configuration.

This is not surprising when considering that the lack of some means for holding the bolt in place is not only inconvenient, in that a bolt otherwise will easily fall out of position if the bow is held in any other than a nearly level posture, which is often not the case when, for example, the crossbowman is walking through woods or other rough terrain or perhaps aiming downwardly from a tree stand, but could present a safety hazard if a bolt was dislodged just as it was being fired, causing it to veer off in an undesired direction.

It will be seen, therefore, that it is desirable to provide a device for maintaining a crossbow bolt in position which not only maintains the bolt securely in the firing configuration, but is easily operated and does not interfere with the bolt's release upon firing.

SUMMARY OF THE INVENTION

In accordance with the present invention a bolt stabilizer is provided that is mounted adjacent the forward end of a crossbow and, cooperating with a bolt rest projecting upwardly at that point, engages the forward end of a bolt positioned in the crossbow to maintain it securely in the firing configuration.

The bolt stabilizer of the present invention includes a narrow, resilient tang which extends parallel to the crossbow stock and includes an offset distal portion disposed in opposition to the upwardly projecting bolt rest.

In a preferred embodiment of the invention the resilient tang is interconnected by means of a transversely extending bridge member to a leg which extends downwardly from the bridge member and is pivoted intermediate its ends.

At its lower end the downwardly extending leg may be provided with a finger tab projecting from the leg substantially parallel to the axis of rotation of the pivot for the leg to permit easy access and manipulation by a crossbowman gripping the forward end of the crossbow stock.

Additionally, the entire stabilizer assembly can be spring loaded by means of a coil spring or the like, thus urging the resilient tang into engagement with the upper surface of a bolt positioned on the crossbow, and yet permitting the bolt-engaging tang to be readily moved into and out of its operative, bolt-engaging position.

These and other features and advantages of the present invention will become apparent from the following description.

DESCRIPTION OF THE PREFERRED EMBODIMENTS

Figure 1:
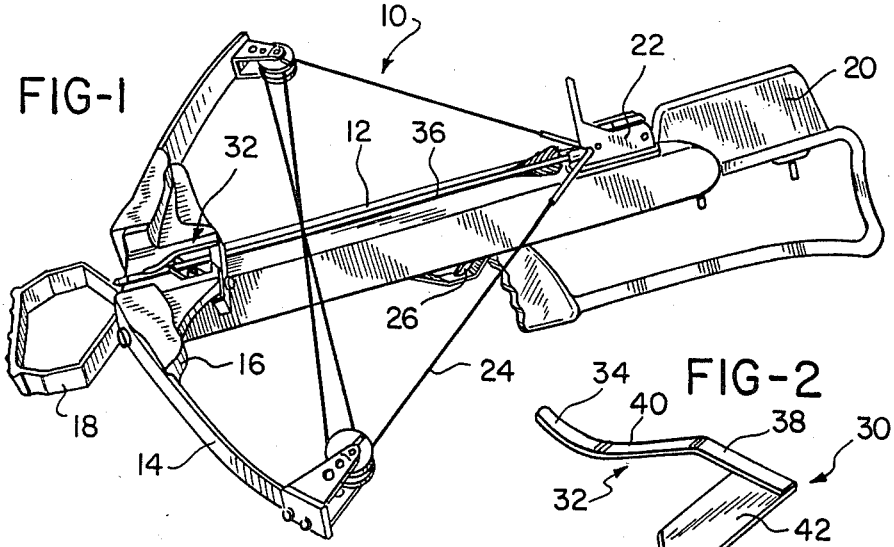
FIG. 1 is a perspective view of a crossbow incorporating the bolt stabilizer of the present invention.
Figure 2:
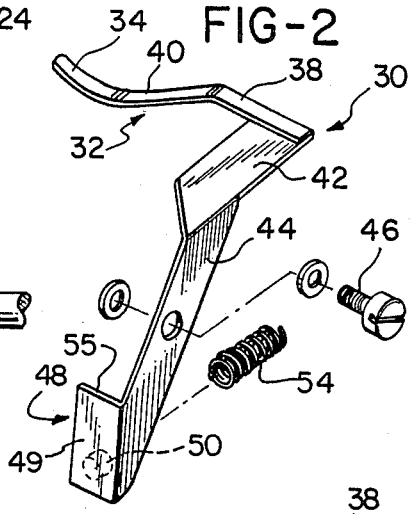
FIG. 2 is an exploded perspective view of the bolt stabilizer of the present invention.
Figure 3:
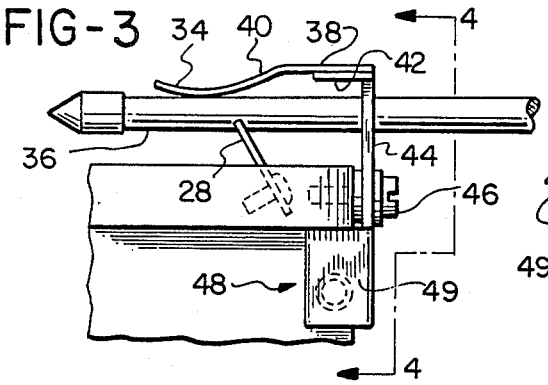
FIG. 3 an elevational view of a portion of a crossbow and bolt showing the bolt stabilizer in engagement with the bolt.
Figure 4:
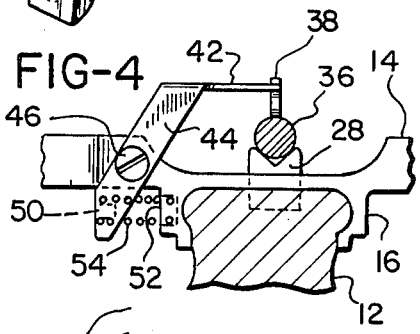
FIG. 4 is a view taken on line 4—4 of FIG. 3.
Figure 5:
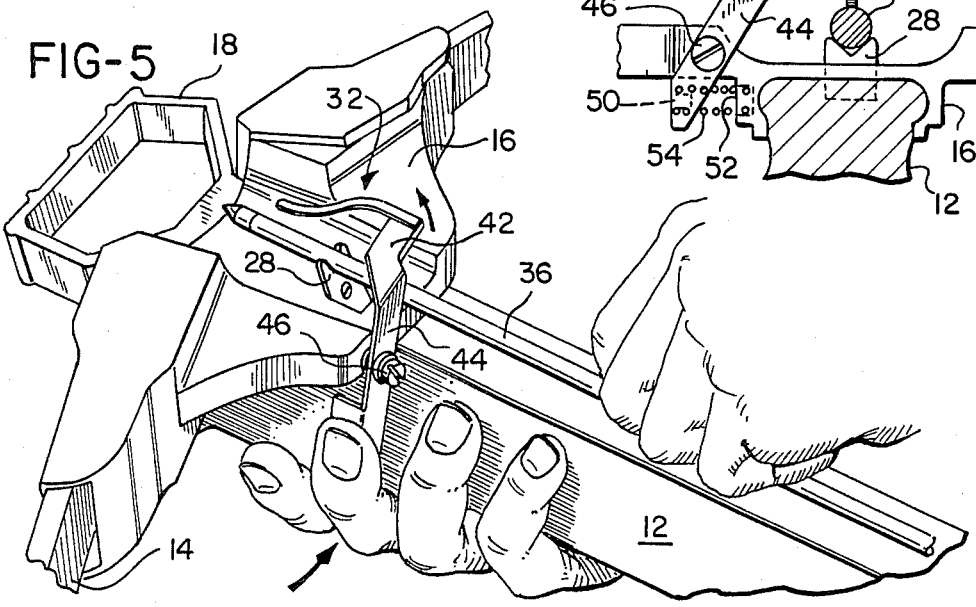
FIG. 5 is a perspective view illustrating manipulation of the stabilizer to permit a bolt to be inserted into firing position.

As seen in FIG. 1 of the drawings, a crossbow 10, which may be of conventional construction, includes a stock 12 and a prod 14 carried by a prod holder 16 mounted adjacent a forward end of a stock 12. Additionally, a stirrup 18 will normally be provided at the forward end of the stock to facilitate cocking the crossbow. Further features of more or less conventional design include a cheek piece 20, a string latch assembly 22 for holding a bow string 24 in the cocked position, a trigger 26 for releasing the latch assembly, and, as best seen in FIGS. 3, 4 and 5, an upwardly projecting bolt rest 28.

A bolt stabilizer 30 is shown in all five figures. of the drawings, and includes a narrow, resilient tang 32 having an offset distal portion 34 to engage an upper surface of a bolt 36 in opposition to the bolt rest 28 engaging a lower surface of the bolt adjacent its forward end. An upper section 38 of the tang is connected to the distal portion 34 by an intermediate portion 40, and the entire tang 32 may be attached by welding or the like to a bridge member 42.

Depending downwardly from the bridge member 42 is a leg member 44, which is pivoted intermediate its ends by a pivot bolt 46. At its lower end leg 44 terminates in a finger tab 48, a flat surface 49 of which is approximately parallel to the axis of rotation of the leg member 44. A button 50 is formed on the inner surface of the finger tab 48, and together with a recess 52 formed in the prod holder 16, secures a coil spring 54, which urges tang 32 downwardly toward the bolt rest 28.

It will be noted, however, that an upper edge 55 of finger tab 48 engages an undersurface of the prod holder 16 to provide a positive stop, and it is, therefore, the resiliency of tang 32 rather than the pressure exerted by spring 54 that holds the bolt in place. Additionally, it will be noted that although the tang is illustrated as welded to the bridge member 42, the entire stabilizer may be formed as an integral unit or the various components or some of them formed separately and interconnected in any convenient manner.

With the above construction and with particular reference to FIG. 5 of the drawings, it will be seen that a crossbowman, after having cocked the bow with the bow string 24 held in the string latch assembly 22, may grasp the stock 12 adjacent its forward end with his right hand and pivot the tang 32 of the stabilizer up away from the bolt rest 28 by pressing the finger tab 48 downwardly, thereby permitting the easy insertion of a bolt 36 into position using his left hand. Pressure is then released from the finger tab 48 permitting the stabilizer to pivot back around to the position shown in FIGS. 1, 3 and 4 of the drawings in opposition to the upwardly projecting bolt rest 28, securely maintaining the bolt in position in the cocked configuration through the resiliency of the tang 34 pressing the bolt lightly but firmly against the bolt rest 28.

While the bolt stabilizer is illustrated as attached to the left hand side of the prod holder, the side on which the stabilizer is mounted will ordinarily be dictated by the convenience of the bowman, and it will be apparent that the stabilizer could just as readily be mounted on the right hand side of the prod holder if so desired by the bowman.

From the above description it will be seen that the present invention provides a bolt stabilizer which is easily manipulatable and inexpensive in construction, and yet provides both the convenience of being able to hold the crossbow in any desired position without dislodging the bolt from its firing configuration and the safety of preventing a misdirected bolt from being fired.

Additionally, with the narrow resilient construction of the bolt-engaging tang there is virtually no frictional resistance exerted against the bolt as it is fired, but yet the stability imparted to the bolt during firing by the light engagement of the bolt on its opposite sides by the bolt rest and the narrow, resilient tang of the stabilizer provides additional stability of the bolt in its initial flight.

While the form of apparatus herein described constitutes a preferred embodiment of this invention, it is to be understood that the invention is not limited to this precise form of apparatus, and that changes may be made therein without departing from the scope of the invention which is defined in the appended claims.

What is claimed is:

1. An improved crossbow assembly comprising a stock having an upper surface and forward and rear ends, a prod holder and a prod carried thereby mounted adjacent said forward end, a bow string carried by said prod, a bolt rest projecting upwardly above said upper surface of said stock adjacent said forward end, a string latch assembly mounted on said upper surface of said stock adjacent said rear end thereof, a bolt having leading and trailing ends, said bolt being supported by said bolt rest adjacent said leading end and at said trailing end by said string latch assembly with said bolt spaced from said upper surface of said stock, a trigger for releasing said latch, a bolt stabilizer mounted adjacent said forward end of said stock, portions of said bolt stabilizer engaging an upper surface of said bolt opposite a lower surface thereof engaged by said bolt rest, said bolt rest and said bolt stabilizer continuously engaging said during firing thereof and imparting stability thereto during said firing.

2. The assembly of claim 1 wherein said stabilizer includes a resilient tang extending substantially parallel to said stock.

3. The assembly of claim 2 wherein said bolt stabilizer further comprises a bridge member projecting laterally of said stock and carrying said tang.

4. The assembly of claim 3 further comrising a leg member projecting downwardly from said bridge member.

5. The assembly of claim 4 further comprising pivot means having an axis of rotation and pivotally mounting said leg member intermediate its ends to said crossbow for pivotal movement about said axis of rotation.

6. The assembly of claim 5 further comprising a finger tab projecting from said leg member adjacent a lower end therefore and having a surface substantially parallel to said axis of rotation of said pivot means.

7. The assembly of claim 6 further comprising spring means urging said leg member to pivot about said pivot means.

* * * * *